US006942014B2

(12) United States Patent
Bonnet

(10) Patent No.: US 6,942,014 B2
(45) Date of Patent: Sep. 13, 2005

(54) HEAT EXCHANGER HAVING AN IMPROVED BAFFLE

(75) Inventor: Pascal Bonnet, Fishers, IN (US)

(73) Assignee: Valeo, Inc., Auburn Hills, MI (US)

( * ) Notice: Subject to any disclaimer, the term of this patent is extended or adjusted under 35 U.S.C. 154(b) by 0 days.

(21) Appl. No.: 10/448,472

(22) Filed: May 30, 2003

(65) Prior Publication Data

US 2004/0251015 A1 Dec. 16, 2004

(51) Int. Cl.[7] ..... F28F 9/00
(52) U.S. Cl. ..... 165/11.1; 165/70; 165/174; 165/110
(58) Field of Search ..... 165/11.1, 70, 110, 165/174

(56) References Cited

U.S. PATENT DOCUMENTS

| | | | | | |
|---|---|---|---|---|---|
| 4,141,409 | A | * | 2/1979 | Woodhull et al. | 165/110 |
| 4,947,931 | A | | 8/1990 | Vitacco | |
| 5,123,483 | A | * | 6/1992 | Tokutake et al. | 165/176 |
| 5,400,853 | A | * | 3/1995 | Wolters | 165/137 |
| 5,450,667 | A | * | 9/1995 | Gire | 29/890.052 |
| 6,019,171 | A | * | 2/2000 | Johnson | 165/174 |
| 6,082,447 | A | | 7/2000 | Insalaco et al. | |
| 6,119,340 | A | | 9/2000 | Insalaco et al. | |
| 6,289,980 | B1 | * | 9/2001 | Insalaco et al. | 165/174 |
| 6,394,176 | B1 | * | 5/2002 | Marsais | 165/140 |

FOREIGN PATENT DOCUMENTS

| | | | | |
|---|---|---|---|---|
| EP | 0 789 213 A2 | | 8/1997 | |
| EP | 0859 209 A1 | | 8/1998 | |
| GB | 2 377 268 | | 8/2003 | |
| JP | 03204595 A | * | 9/1991 | F28F/1/12 |
| WO | WO 00/29801 | | 5/2000 | |

* cited by examiner

*Primary Examiner*—Allen J. Flanigan
(74) *Attorney, Agent, or Firm*—Ronald Courtney

(57) ABSTRACT

The present invention is directed to a heat exchanger for an automotive vehicle. The heat exchanger includes a first end tank divided into a first portion and a second portion by a baffle, the first end tank including a through-hole.

The baffle system includes a baffle or baffles with a central portion and at least one flanged peripheral portion, the flanged peripheral portion having a peripheral channel. Additionally, the baffle preferably is disposed within the end tank so that the peripheral channel is substantially juxtaposed with the through-hole in the end tank for providing a visual leak indicator.

13 Claims, 3 Drawing Sheets

HEAT EXCHANGER HAVING AN IMPROVED BAFFLE

FIELD OF THE INVENTION

The present invention relates generally to a heat exchanger and more particularly a multi-fluid heat exchanger, employing an improved baffle.

BACKGROUND OF THE INVENTION

In the automotive industry, in particular, it has become increasingly necessary to combine multiple functions in a single heat exchanger assembly. The need to reduce the number of overall components and to optimize assembly efficiency has driven the need for improved heat exchanger devices that combine increasingly efficient designs and multiple functions in packaging heretofore attainable using plural separate components or devices having inefficient designs. More specifically, there has been a growing need for an improved heat exchanger device, particularly for under the hood automotive vehicle applications, which combines multiple functions in a single assembly that is efficient to make and operate and that occupies substantially the same or less space than existing heat exchanger devices. Due to relatively recent advancements in the field, including, in particular, the development of combination heat exchanger assemblies or 'combo coolers', there is also a need to develop systems of more than one baffle to insure that multiple fluids be maintained basically separated from one another.

As stated above, particularly where a multifluid heat exchanger is to be employed, it is attractive to be able to maintain each of the different fluids of the exchanger separated from each other, The employment of baffles is one possible approach. However, until the present invention, baffle designs have often resulted in space problems, and the like, contributing to the loss of function or efficiency of one or more of the heat exchanger tubes. In particular, certain heat exchanger assemblies may have space requirements that extend to at least one core tube end in the tank. In such assemblies, space restrictions have led to "rolling" of baffle perimeter walls or "flanges" that increase bonding against the tank perimeter and take up additional space that eventually restricts performance due to the fact that tube center to center spaces can not be optimized. Thus, it would be especially desirable for an improved baffle design that can be incorporated into a heat exchanger, and particularly a multi-fluid heat exchanger, which makes efficient use of all heat exchanger tubes.

SUMMARY OF THE INVENTION

The present invention is directed to a heat exchanger for an automotive vehicle. The heat exchanger includes a first end tank divided into a first portion and a second portion by a baffle, the first end tank including a through-hole. The heat exchanger also includes a plurality of a first tubes in fluid communication with the first portion of the first end tank, the plurality of first tubes configured to have a first fluid flow there through. Preferably a plurality of second tubes are in fluid communication with the second portion of the first end tank, the plurality of second tubes configured to have a second is fluid, different from the first fluid, flow there through. It is also preferable for the heat exchanger to include a plurality of fins disposed between the first tubes and the second tubes. The baffle system includes a baffle or baffles with a central portion and (at least one) flanged peripheral portion, the flanged peripheral portion having a peripheral channel. Additionally, the baffle preferably is disposed within the end tank so that the peripheral channel is substantially juxtaposed with the through-hole in the end tank for providing a visual leak indicator and also substantially juxtaposed with at least one of the fins in the space between the tubes. Preferably, the baffle system comprises double baffles, i.e. a first and a second baffle being assembled back to back with a common center contact portion.

In particular, in combo coolers, a common tank section often needs a separator between the separate fluid systems. It has been found that a baffle, or, in particular, a double (or multiple) baffle system, can be used that provides the separation of fluids necessary for adequate functioning of heat exchange for each fluid. Preferably, in combination heat exchanger assembles or combo coolers, two separate baffles with a space in between the baffles may be used to ensure that the separate fluids of the multi-fluid systems remain essentially separated from one another.

In a particular embodiment of the invention, a "hole" or "weep hole" may be placed on the cover surface between double baffles, to provide a communication towards the exterior. In an even more preferred embodiment, the entry passage is placed on the cover surface so as to enable entry of (fluid) materials) such as flux, to prepare any wetted surfaces for brazing or the like. An additional preferred feature and advantage of such an embodiment is that said entry passage may also provide a means to facilitate leak detection. In preferred embodiments, the double baffle has an outer perimeter edge separated by a short distance to provide a relief channel at the sealing edge. Even more preferred is a sealing edge which is not 'rolled' or flanged, thus reducing the overall width of the baffle between the tubes for shorter tube spacing. In a particularly preferred embodiment, the double baffle is of a reduced thickness being assembled back to back with a common center contact portion area, which leads to the central portion much increased and may preferentially be one and one half time, double or more, than the thickness to resist higher pressures. The sealing perimeter outward variance of preferred embodiments also provide greater axial stability of the baffle during assembly.

BRIEF DESCRIPTION OF THE DRAWINGS

FIG. 1—Prior art Spaced baffles with dead tube in between.

DETAILED DESCRIPTION OF THE PREFERRED EMBODIMENT

Figure 1:
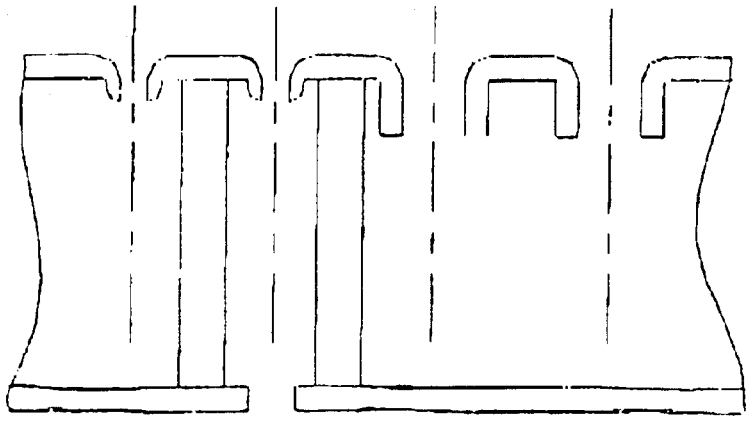

Generally, the present invention relates to a heat exchanger and to a method of forming the heat exchanger. The heat exchanger may be a single fluid or multi-fluid (e.g., 2, 3 or 4 fluid) heat exchanger. The heat exchanger may also be a single pass or multi-pass heat exchanger. Although the heat exchanger according to the present invention may be used for a variety of articles of manufacture (e.g., air conditioners, refrigerators or the like), the heat exchanger has been found particularly advantageous for use in automotive vehicles. For example, the heat exchanger may be used for heat transfer of one or more various fluids within a vehicle such as air, oil, transmission oil, power steering oil, radiator fluid, refrigerant, combinations thereof or the like. For example, in a highly preferred embodiment of the present invention there is contemplated a multi-fluid heat exchanger that includes a condenser in combination with an oil cooler selected from the group consisting of a power steering oil cooler, a transmission oil cooler, a radiator fluid and a combination thereof.

The present invention is further optimized by the employment of an improved heat exchanger tube, the employment of a bypass or a combination thereof, Heat exchangers of the present invention will typically include one or more tubes, one or more end tanks, one or more inlets and outlets, one or more baffles, one or more fins or a combination thereof. Depending upon the embodiment of the heat exchanger, various different shapes and configurations are contemplated for the components of the heat exchanger. For example, and without limitation, the components may be integral with each other or they may be separate. The shapes and sizes of the components may be varied as needed or desired for various embodiments of the heat exchanger. Additional variations will become apparent upon reading of the following description.

According to one aspect of the invention, one or more of the components of the heat exchanger such as the baffles, the end tanks, the tubes, the inlets, the outlets, a bypass or combinations thereof may be attached to each other using brazing techniques. Although various brazing techniques may be used, one preferred technique is referred to as controlled atmosphere brazing. Controlled atmosphere brazing typically employs a brazing alloy for attaching components wherein the components are formed of materials with higher melting points than the brazing alloy. The brazing alloy is preferably positioned between components or surfaces of components to be joined and, subsequently, the brazing alloy is heated and melted (e.g., in an oven or furnace, and preferably under a controlled atmosphere). Upon cooling, the brazing alloy preferably forms a metallurgical bond with the components for attaching the components to each other. According to one highly preferred embodiment, the brazing alloy may be provided as a cladding on one of the components of the heat exchanger. In such a situation, it is contemplated that the components may be formed of a material such as a higher melting point aluminum alloy while the cladding may be formed of a lower melting point aluminum alloy.

In general, a preferred heat exchanger contemplates at least two spaced apart end tanks bridged together in at least partial fluid communication by plurality generally parallel tubes, with fins disposed between the tubes.

Figure 2:
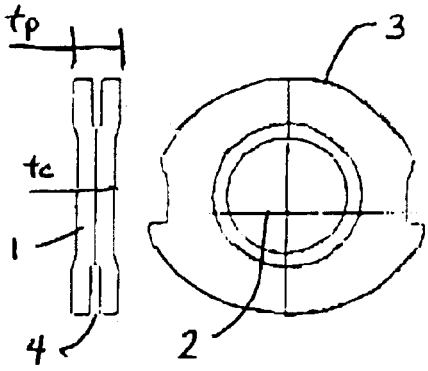
FIG. 2—Basic Concept—Double baffle with specific edge perimeter periphery portion and center contact portion FIG. 3—Double baffle with specific peripheral edge portion and specific center contact portion to improve pressure capability FIG. 4—Alternative Concepts—Double baffle with specific perimeter shape and dimples for separation FIG. 5—Double baffle showing one or more holes for, for example, flux entry and/or drainage FIG. 6—Asymmetric double baffle with varied channel width along the perimeter portion of the baffle

More specifically, referring to FIG. 2, there is illustrated a double baffle according to one preferred aspect of the present invention. The double baffle 1 includes a common center contact portion (2). Additionally, it includes a peripheral portion (3).

Figure 3:
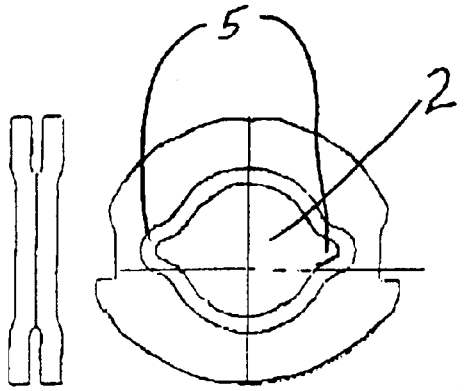

FIG. 3 in addition to a common center contact portion (2) additionally includes two lateral extensions (5).

Figure 4:
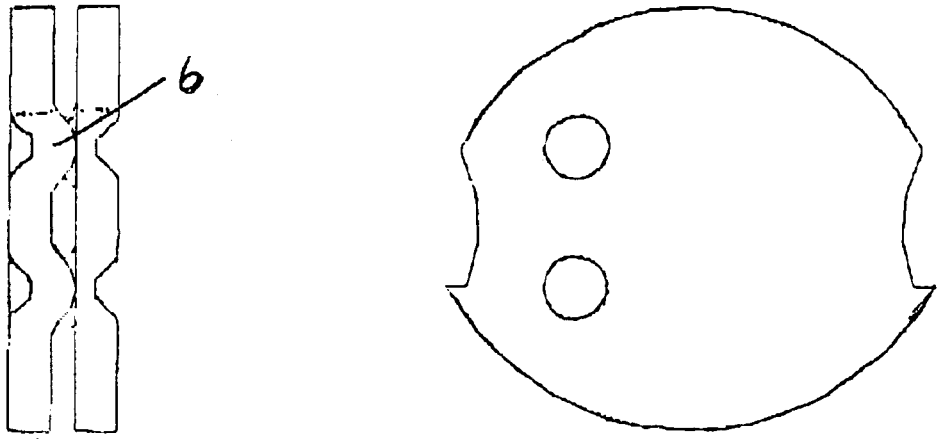

FIG. 4 includes two parallel rows of dimples (6) for separation.

Figure 5:
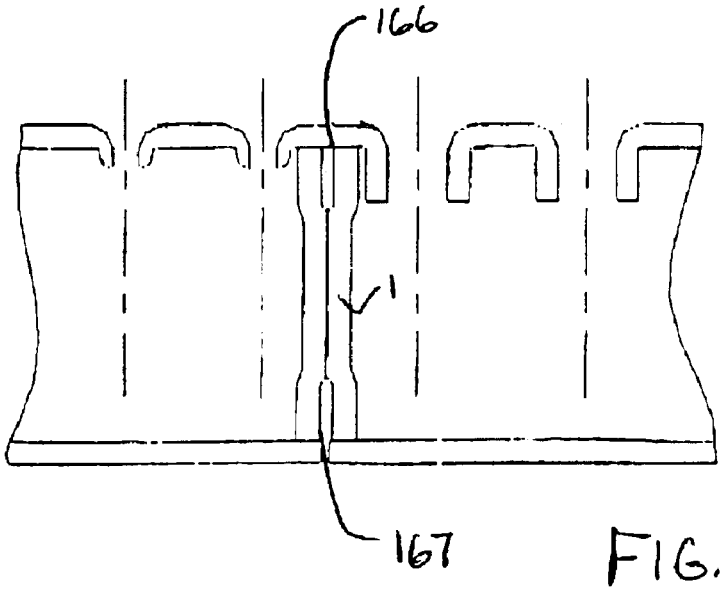

FIG. 5 shows a peripheral surface (166) and a weep hole (167).

Figure 6:
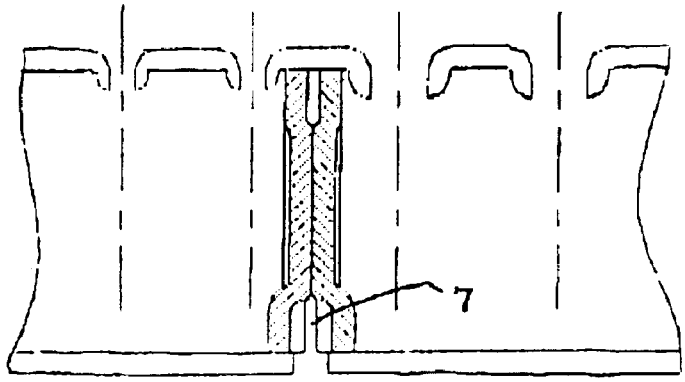

FIG. 6 includes an asymmetrical double baffle (2) with peripheral wall spacing beyond the tube slot area (7) to allow an enlarging of the hole dimension.

From the above, it will thus be appreciated that one preferred method of the present invention contemplates providing a multi-fluid heat exchanger assembled in a common assembly, passing a first fluid through one portion of the heat exchanger for heat exchange, and passing at least one additional fluid through at least one additional portion of the heat exchanger for heat exchange of the additional fluid.

Preferably, a heat exchanger in accordance with the present invention includes at least one baffle (more preferred at least one double baffle) for dividing a region within a component of a heat exchanger into two or more portions. The double baffle of the present invention may be provided in a variety of different shapes and having a variety of configurations depending upon which component of the heat exchanger the baffle is to be placed within and also depending, for instance, upon the configuration of that component.

According to one preferred embodiment, the portions separated by the double baffle are part of an internal opening within an end tank of the heat exchanger. According to a highly preferred embodiment, the baffle, or preferably double baffle, is employed to separate the respective portions in a multi-fluid heat exchanger wherein each of the subdivided portions is adapted to receive the same fluid under different conditions, or different fluids. As to the latter, for example, one portion may receive a first fluid (e.g., a condenser fluid or the like) while the other portion receives a second fluid (e.g., a transmission oil or power steering oil), which is different from the first fluid. In this manner, the use of baffles allows different fluids of a multi fluid heat exchanger to be maintained separate from each other as they flow through the heat exchanger. In a most preferred embodiment, the double baffle is asymmetric.

According to other more preferred embodiments, the present invention seeks to provide a double baffle, of which one example is shown in FIG. 2. In these preferred embodiments the overall thickness of the double baffle is reduced. At the common contact area (1), the effect of the 'combined' or 'double' baffle is to provide a common central portion area more resistant to higher pressures.

The ratio of the average thickness (tc) of the central portion relative to the average thickness (tp) of the peripheral portion preferably ranges from about 0.40:1 to about 0.90:1. In one particularly preferred embodiment, where the double baffle has an approximate average diameter of about 10 to about 30 mm, the central portion average thickness is preferably no greater than about 4.0 mm, more preferably no greater than about 3.6 mm and most preferably it is about 3.0 mm thick. The peripheral portion average thickness is preferably no greater than about 10 mm, more preferably no greater than about 7.5 mm even more preferably less than about 6 mm and most preferably it us less than or equal to about 4.0 mm thick. Thus, the ratio of the average thickness of the peripheral portion to the average diameter (or corresponding cross sectional dimension) of an end tank or other structure into which it is introduced, at the desired baffle site, is about 1:1 to about 1:0.15, and more preferably is about 1:0.30. Other dimensions may also be employed provided that the resulting needs for thermal and structural stability are achieved.

Also preferred are structures where the common central portion has a first thickness and the peripheral portion has a second thickness and wherein the ratio of the first thickness to the second thickness is between about 0.40 to about 0.90.

In various preferred embodiments, the thickness of the central portion is no greater than about 3 mm. Also preferred are embodiments wherein the thickness of the peripheral portion is no greater than about 6 mm.

It may be possible to achieve the desired resulting structure using any of a number of art-disclosed forming techniques. For example, a coining, casting, machining or other suitable operation may be employed. According to one preferred embodiment the baffle is formed by attaching (e.g., with a weld, an adhesive, a brazed, a solder, a mechanical fastener, or otherwise) two substantially identical metal plates 180, 182 (e.g., stamped aluminum plates) together in mirror symmetrical relation to each other.

Once formed, the double baffle 1 is installed within a heat exchanger, such as within the interior of an end tank. It will be appreciated that the peripheral surface 166 of the double baffle 1 preferably has a shape that approximates the inner wall surface of the end tank so that the peripheral surface is substantially engaged with the inner wall surface of the end tank about the peripheral surface, thereby facilitating sealing as desired between end tank subdivided portions. Optionally a seal or gasket is applied to the peripheral surface for assuring seal integrity.

Preferably, the double baffle 1 is positioned within an opening of the end tank to separate a first portion of the opening from a second portion of the opening. The first outer surface preferentially faces the first portion and the second outer surface faces the second portion In one highly preferred embodiment though not required, the baffle or double baffle is adapted for providing leak detection or for otherwise assuring seal integrity. To do so, it is preferred that the end tank be provided with at least one through-hole. During assembly, the baffle is positioned so that the through-hole is substantially juxtaposed with the channel of the baffle. In this manner, it will be appreciated that if there is a faulty seal between portions of the end tank, fluid from that portion will enter the channel and exit through the through-hole. The fact of a leak is then detectable by the fluid escape. The location of the faulty seal is also pinpointed by analyzing the escaped fluid to determine from which portion of the end tank it originated.

It is contemplated that various techniques may be used to secure the double baffle within the end tank. For example, the double baffle 1 may be interference fit within the tank and seals (not shown) may be used to prevent passage of fluid past the double baffle 1. Alternatively, the double baffle 1 may be adhesively bonded at its peripheral surface 1 to the end tank. In a highly preferred embodiment, the outer peripheral surface of the double baffle 1 substantially corresponds to an inner surface of the end tank such that the outer peripheral surface and the inner surface substantially continuously oppose and contact each other. Accordingly, the outer peripheral surface may be attached to the inner surface by welding brazing or the like.

Advantageously, the double baffle 1 provides good resistance to pressures, or pressure fluctuations provided by fluids within the portions of the end tank, particularly in a preferred embodiment that includes two plates integrated for reinforcing each other. Also advantageous, the double baffle 1 can provide fluid tight seals separated by the cavity since the outer peripheral surface is separated into portions by the cavity. Thus, each of the seals can buffer the other from pressure fluctuations thereby providing greater overall sealing between the portions of the end tank. As an added advantage, the double baffle 1 is relatively thin and is without thick rolled edges. As a result, it requires less volume to perform its function. The double baffles 1 are thus fit between tube entrances and exits to the end tank without interfering with flow of fluid through the tubes. The flexibility in mounting also helps to assure that the presence of dead tubes or other tube inefficiencies can be avoided Other embodiments of baffles other than the ones described above are also within the scope of the present invention, including but not limited to the additional preferred embodiments that are described in the following discussion. It should be understood that principles of operation and assembly of the embodiments described in the following are substantially identical to the double baffle 1 and end tank of FIG. 5, and the description of those general aspects applies also to the embodiments in the following discussion. Therefore, to avoid repetition, the description of the embodiments will focus more on unique structural features of the embodiments.

Referring to FIG. 3, and referring to FIG. 4 there are illustrated other alternative baffles.

Generally, it is contemplated and in fact, expected that various changes may be made to the preferred embodiments of the baffles and double baffles to accommodate different designs of heat exchangers while still remaining within the scope of the present invention. As an example, and referring to FIG. 6, there is illustrated another alternative double baffle 2 which is asymmetric. Such a double baffle would preferable rest within an end tank of a heat exchanger. The alternative double baffle may be compared to the original double baffle 1 of FIGS. 2–5 however, the exception that the alternative baffle 2 of FIG. 6 is, most preferably, asymmetrical. Alternative double baffle 2 of FIG. 6 preferentially includes an annular cavity with an axially expanded portion for accommodating a larger through-hole or holes extending through a wall of the end tank. In another alternative, the double baffle has a channel area around the entire perimeter and comprising one or more 'holes' and/or 'slots' or the like which are approximately equivalent and aligned with the width of the channel.

As indicated previously, the baffles of the present invention are useful in a number of different applications. In one preferred use an end tank for a multi-fluid heat exchanger is provided and is subdivided with at least one baffle in accordance with the present teachings. In another embodiment, a double baffle as described herein is employed to subdivide an end tank of a single fluid heat exchanger. The present baffles need not be used only to subdivide end tanks, but may be used to subdivide any structure that provides a fluid passageway. In still another preferred embodiment, the peripheral walls spacing varies to a wider position beyond the tube slot area (FIG. 6, rep. 3) in order to allow an enlarging of the hole dimension.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger for an automotive vehicle, comprising:

a first end tank divided into a first portion and a second portion by a baffle the first end tank including a through-hole;

a plurality of a first tubes in fluid communication with the first portion of the first end tank, the plurality of first tubes configured to have a first fluid flow there-through; and a plurality of second tubes in fluid communication with the second portion of the first end tank, the plurality of second tubes configured to have a second fluid, different from the first fluid, flow there-through;

wherein:

i) the baffle system comprises a double baffle, each baffle including a common central portion and a peripheral portion, the peripheral portion creating a peripheral channel; and ii) each baffle is disposed within the end tank so that the double baffles have a common center contact portion and a peripheral flange portion; and wherein one or more baffles is asymmetric.

2. A heat exchanger as in claim 1 wherein each baffle system is asymmetric.

3. A heat exchanger having a tank and double baffle for an automotive vehicle, comprising:

a first end tank divided into a first portion and a second portion by a baffle the first end tank including a through-hole;

a plurality of a first tubes in fluid communication with the first portion of the first end tank, the plurality of first tubes configured to have a first fluid flow there-through; and a plurality of second tubes in fluid communication with the second portion of the first end tank, the plurality of second tubes configured to have a second fluid, different from the first fluid, flow there-through;

wherein:

i) the baffle system comprises a double baffle, each baffle including a common central portion and a peripheral portion, the peripheral portion creating a peripheral channel; and ii) each baffle is disposed within the end tank so that the double baffles have a common center contact portion and a peripheral flange portion; and wherein the common central portion is greater than one and one half times the width of its peripheral walls, and the through-hole is positioned so as to allow visual leak detection at the level of the baffle through the through-hole.

4. A heat exchanger as in claim 1 wherein the common central portion has a first thickness and the peripheral portion has a second thickness and wherein the ratio of the first thickness to the second thickness is between about 0.40 to about 0.90.

5. A heat exchanger as in claim 4 wherein the thickness of the central portion is no greater than about 3 mm.

6. A heat exchanger as in claim 4 wherein the thickness of the peripheral portion is no greater than about 6 mm.

7. A heat exchanger as in claim 1 wherein the tube to tube center distances are less than 10 mm.

8. A heat exchanger for an automotive vehicle, comprising:

a first end tank divided into a first portion and a second portion by a baffle the first end tank including a through-hole;

a plurality of a first tubes in fluid communication with the first portion of the first end tank, the plurality of first tubes configured to have a first fluid flow there-through; and a plurality of second tubes in fluid communication with the second portion of the first end tank, the plurality of second tubes configured to have a second fluid, different from the first fluid, flow there-through;

wherein:

i) the baffle system comprises a double baffle, each baffle including a common central portion and a peripheral portion, the peripheral portion creating a peripheral channel; and ii) each baffle is disposed within the end tank so that the double baffles have a common center contact portion and a peripheral flange portion; and wherein the double baffle is formed of a first stamped metal plate and a second stamped metal plate.

9. A heat exchanger for an automotive vehicle, comprising:

a first end tank divided into a first portion and a second portion by a baffle the first end tank including a through-hole;

a plurality of a first tubes in fluid communication with the first portion of the first end tank, the plurality of first tubes configured to have a first fluid flow there-through; and a plurality of second tubes in fluid communication with the second portion of the first end tank, the plurality of second tubes configured to have a second fluid, different from the first fluid, flow there-through;

wherein:

i) the baffle system comprises a double baffle, each baffle including a common central portion and a peripheral portion, the peripheral portion creating a peripheral channel;

ii) each baffle is disposed within the end tank so that the double baffles have a common center contact portion and a peripheral flange portion; and iii) the through-hole is substantially juxtaposed with the channel of the baffle.

10. A heat exchanger as in claim 9 wherein the common central portion has a first thickness and the peripheral portion has a second thickness and wherein the ratio of the first thickness to the second thickness is between about 0.40 to about 0.90.

11. A heat exchanger as in claim 10 wherein the thickness of the central portion is no greater than about 3 mm.

12. A heat exchanger as in claim 10 wherein the thickness of the peripheral portion is no greater than about 6 mm.

13. A heat exchanger as in claim 9 wherein the tube to tube center distances are less than 10 mm.

* * * * *